US005226264A

United States Patent [19]

Walters

[11] Patent Number: 5,226,264

[45] Date of Patent: Jul. 13, 1993

[54] PORTABLE SHELTER FOR AIR CONDITIONER

[76] Inventor: David P. Walters, P.O. Box 225, Hwy. 37 East, Morgan, Ga. 31766-0225

[21] Appl. No.: 637,543

[22] Filed: Jan. 4, 1991

[51] Int. Cl.[5] ..... E04B 1/12

[52] U.S. Cl. ..... 52/63; 135/109

[58] Field of Search ..... 52/63, 64, 202; 135/109, 101, 102, 115, 118

[56] References Cited

U.S. PATENT DOCUMENTS

| | | | |
|---|---|---|---|
| 256,661 | 4/1882 | Tarragon | 52/64 |
| 1,946,567 | 2/1934 | Braunworth | 52/63 |
| 2,811,977 | 11/1957 | McClish | 135/109 |
| 3,155,427 | 11/1964 | Necessary | 135/109 |
| 3,534,514 | 10/1970 | Gellert | 52/222 |
| 3,799,608 | 3/1974 | Smutny et al. | 135/109 |
| 4,389,827 | 6/1983 | Van Valkenburg | 52/202 |
| 4,748,995 | 6/1988 | Viglione | 135/109 |
| 4,870,984 | 10/1989 | Roth | 52/63 |
| 4,884,589 | 12/1989 | Simpson | 52/63 |

*Primary Examiner*—Carl D. Friedman
*Assistant Examiner*—Joanne C. Downs
*Attorney, Agent, or Firm*—Richard C. Litman

[57] ABSTRACT

Disclosed is a portable shelter for air conditioner units, comprising a frame assembly mounted on wheels and configured to have a sloping top and parallel sides, the frame assembly being provided with a thermal reflective cover and anchoring means, whereby an outdoor air conditioner unit may be easily protected from the heat of the sun's rays and from the elements, including rain, wind driven debris and leaves, thereby allowing the air conditioner unit to function more efficiently at a lower temperature.

16 Claims, 2 Drawing Sheets

PORTABLE SHELTER FOR AIR CONDITIONER

BACKGROUND OF THE INVENTION

1. Field of the Invention

This invention relates to central air conditioners, more specifically to a portable shelter for central air conditioners to improve operating efficiency and to provide for year-round protection against the elements and the accumulation of debris.

Many outdoor central air conditioner units are exposed to intense heat from direct sunlight. This solar heating of the metal air conditioner case and components causes the unit to consume more electrical energy during operation thereof. The additional heat also causes component stress.

The heating problem is compounded when the central air conditioner coils and blower housing are not kept free of debris (i.e., leaves, pine needles, sticks, freshly cut grass, dirt, etc.). While the air conditioner unit is operating, it draws debris into the coils. When the air conditioner is not operating, debris can enter through the vents and blower fan outlet. As this debris accumulates, the operating temperature of the air conditioner unit increases, which in turn causes more electrical energy consumption. Frequent service intervals are required to remove the accumulated debris.

2. Description of the Prior Art

Inventors have designed precoolers for an evaporative type cooler. Such an invention is described in U.S. Pat. No. 4,612,778 issued to Michael V. Medrano on Sep. 23, 1986. The Medrano precooler uses a water distribution system to wet the incoming air before it is discharged by a blower fan. This type of precooler is directly affected by the sun's heat. In direct sunlight, this system loses cooling effectiveness due to thermal heating of the outer metal components, and offers no effective protection from debris clogging the air intake. It also adds humidity to the outgoing air which is a distinct disadvantage in areas of high humidity.

Air conditioner covers are known that attach directly to the compressor cabinet. Such a cover is described in U.S. Pat. No. 4,745,769 issued to Odell Wooden, Jr. on May 24, 1988. This type of cover may be used during the off season when the air conditioner is not in use. If this type of cover were designed with openings to allow exhaust air to escape and intake air to enter, there would be no protection from debris entering the unit. In areas of high humidity, condensation will accumulate between this type of cover and the compressor cabinet, therefore promoting rust deterioration. This type of cover does nothing to protect the air conditioner from solar heat or heat build-up during operation, and therefore has no positive impact on energy conservation. In fact, this type of cover would restrict heat dissipation which would increase energy consumption during operation of the air conditioner.

SUMMARY AND OBJECTS OF THE INVENTION

It is an object of the invention to provide a shelter for a central air conditioner unit by using a separate covered frame structure comprising three sides and a roof on wheels which may be rolled into place over a central air conditioner metal housing.

It is another object of the invention to provide a shelter for a central air conditioner unit using thermally efficient and reflective materials as the cover on the frame structure. These materials offer year-round protection and help prevent heat build-up on the air conditioner metal housing and components during operation of the central air conditioner.

It is another object of the invention to provide a shelter for a central air conditioner unit that protects the components and outer metal housing from solar heat or heat build-up, thereby consuming less electrical energy during operation of the central air conditioner.

It is a further object of the invention to provide a shelter for a central air conditioner unit that protects all the painted surfaces of the unit from rust deterioration. The shelter also protects the outer metal housing and components from stains and oxidation.

It is a further object of the invention to provide a shelter for a central air conditioner unit configured to prevent debris from entering the outer metal housing of the unit from the top and sides year-round, thereby keeping the unit cleaner whereby less maintenance and service during the life of the unit is required.

It is a further object of the invention to provide a shelter for a central air conditioner unit which provides protection from inclement weather year-round.

It is still another object of the invention to provide a shelter for a central air conditioner unit that is portable, and which can be rolled out of the way or moved by hand should the unit need maintenance and service.

Another object of the invention is to provide a shelter for a central air conditioner unit that is inexpensive to manufacture.

The cover and frame can be manufactured in various sizes in kit or modular form, or one size that is adjustable to accommodate different air conditioner cabinet dimensions. It can be easily assembled by the user and rolled into place. The shelter may be held in place with a quick-release ground-anchoring system. The anchors protect the shelter from displacement should it be bumped or subjected to high winds.

The shelter includes an inclined roof which provides plenty of exhaust airspace, the configuration directing the exhaust air to escape out the back of the shelter. There is also ample space between the shelter walls and the air conditioner metal housing to allow a continual supply of fresh intake air. By using thermally efficient and reflective materials for the shelter cover, the intake air remains cooler. The cover material also prevents debris build-up, thereby lowering maintenance costs. A cleaner and cooler air conditioner consumes less electrical energy during operation. The functional and modern design of the shelter also adds attractiveness to the home.

Due to the heating effect of the sun, the outside temperature of a central air conditioner metal cabinet can reach as high as 135 degrees Fahrenheit during the summer months. Covering the cabinet with the thermally efficient and reflective shelter can reduce the metal cabinet temperature by as much as 50 degrees Fahrenheit. A 14% to 16% reduction in monthly electric bills during the summer months can be realized by using the shelter.

Other objects, features and advantages of this invention will be apparent from the following detailed description and the appended claims, reference being had to the accompanying drawings forming a part of the specification, wherein like reference numerals designate corresponding parts of the several views.

DETAILED DESCRIPTION OF PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also, it is to be understood that the phraseology and terminology employed herein is for the purpose of description and not limitation.

Figure 1:
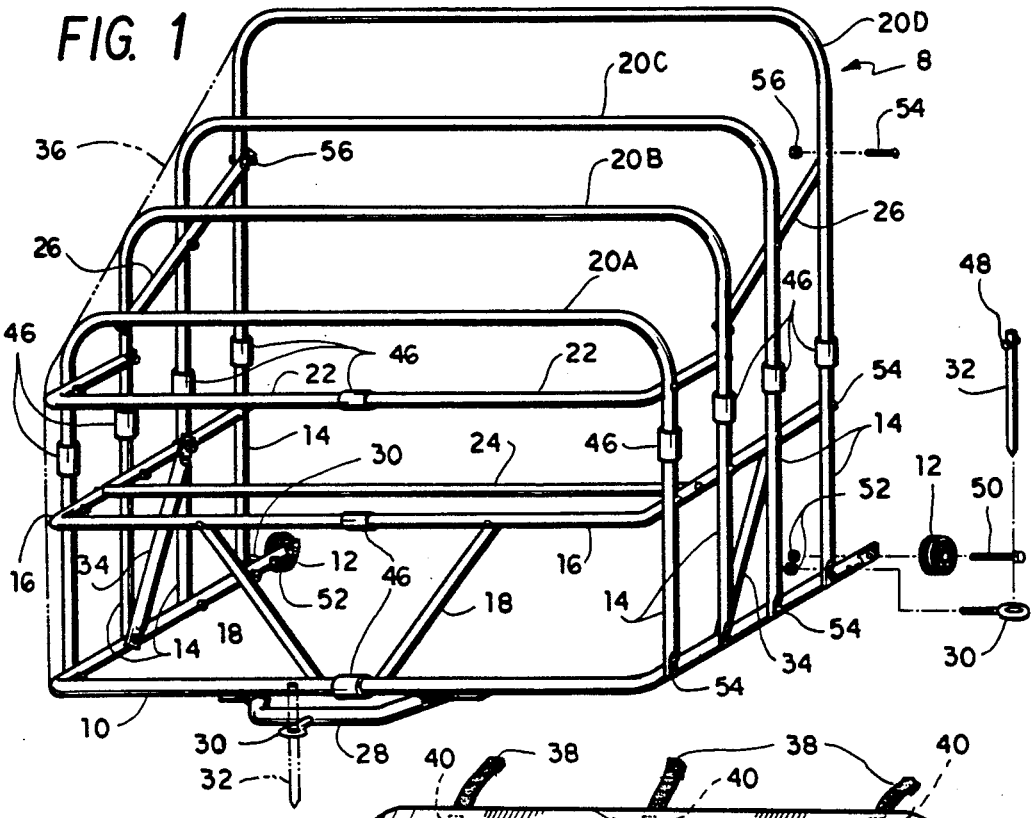
FIG. 1 is a perspective view showing the framework of the portable shelter.

FIG. 1 shows the frame assembly 8 for the portable shelter for the air conditioner. Reference numeral 10 denotes the lower support frame which is constructed in two halves from tubing, each half containing a 90 degree bend, the halves being connected by either a common tubing connector 46 or a swaged connection where one tube fits inside the other. This tubing used is ½ inch or ¾ inch galvanized steel. The front stand or handle 28 is of the same type tubing bent to facilitate connection to the lower support frame 10 by any suitable means, not shown, such as bolts which go through the front stand or handle 28 and lower support frame 10 and are secured by nuts. Wheels 12 are formed of polyurethane and can be three to five inches in diameter depending on the size of the frame. Wheels 12 are mounted to the rear of lower support frame 10 by means of axle bolts 50 which respectively go through each wheel 12 and frame 10 and are secured by lock nuts 52.

Vertical roof support tubes or frames 14 are mounted on lower support frame 10 by means of bolts 54 and lock nuts 56 and carry at the top thereof conventional tubing connectors 46. Connected to tubes 14 is a lower U-shaped frame support 16 by means of bolts 54 and lock nuts 56. The lower U-shaped frame support 16 consists of two halves, each consisting of one 90 degree bend and both halves connected by a conventional tubing connector 46 or a swaged connection. Also provided are two front frame supports 18 connected to form a V to the lower U-shaped frame support 16 and the lower support frame 10 by bolts 54 and lock nuts 56.

Connected to vertical roof support tubes or frames 14 are four roof support beams 20A, 20B, 20C and 20D. The roof support beams 20A–20D are mounted on vertical roof support tubes or frames 14 by means of conventional tubing connectors 46 or by means of swaging. Connected to roof support beams 20A–20D is an upper U-shaped frame support 22, an air conditioner bumper guard 24, and side frame supports 26. Anti-sway bars 34 are shown connected to lower support frame 10 and lower U-shaped frame support 16. The upper U-shaped frame support 22 is formed of two pieces of tubing with each containing a 90 degree bend, the tubing being connected by a conventional tubing connector 46 or swaged connection. This V-shaped frame support is attached to the first two roof support beams 20A and 20B with conventional bolts 54 and nuts 56. The air conditioner bumper guard 24 is a straight piece of tubing flattened on each end and connected to the lower U-shaped frame support 16, by way of example only, by means of nuts and bolts. The side frame supports 26 consist of two identical-length pieces of tubing bolted to the second, third and fourth roof support beams 20B, 20C and 20D at a 45-degree angle on each side. The two anti-sway bars 34 are identical in length, and are connected between the lower support frame 10 and the lower U-shaped frame support 16 at a 65 degree angle. The anti-sway bars 34 are attached by means of conventional bolts 54 and nuts 56.

The portable shelter includes an anchoring system to secure the frame assembly 8 to the ground. The anchoring system consists of three eyebolts 30, two of which are secured to the lower support frame 10 at the wheel end thereof by means of lock nuts 52. The third eyebolt 30 is attached to the front stand or handle 28 in the same manner. Also included in the anchoring system are three solid steel anchoring rods 32. Each anchoring rod 32 has a hole drilled near the top to accommodate a conventional bolt and nut, collectively identified by reference numeral 48, the bolt being inserted through the hole in anchoring rod 32. The anchoring rod 32 is driven through the eyebolt 30 into the ground until the bolt and nut 48 are seated on eyebolt 30. The frame assembly 8 can be easily removed by removing the bolts and nuts 48 from the anchoring rods 32 and lifting the frame assembly 8 upward.

Figure 2:
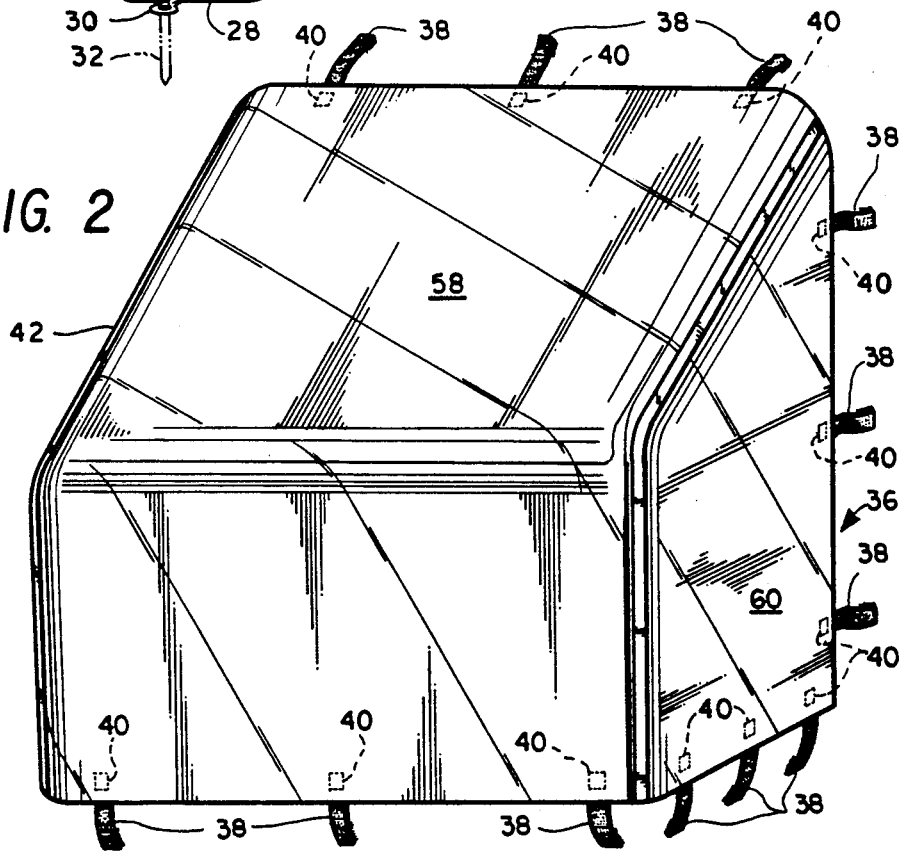
FIG. 2 is a perspective view showing the reflective cover mounted on the framework of the portable shelter.
Figure 3:
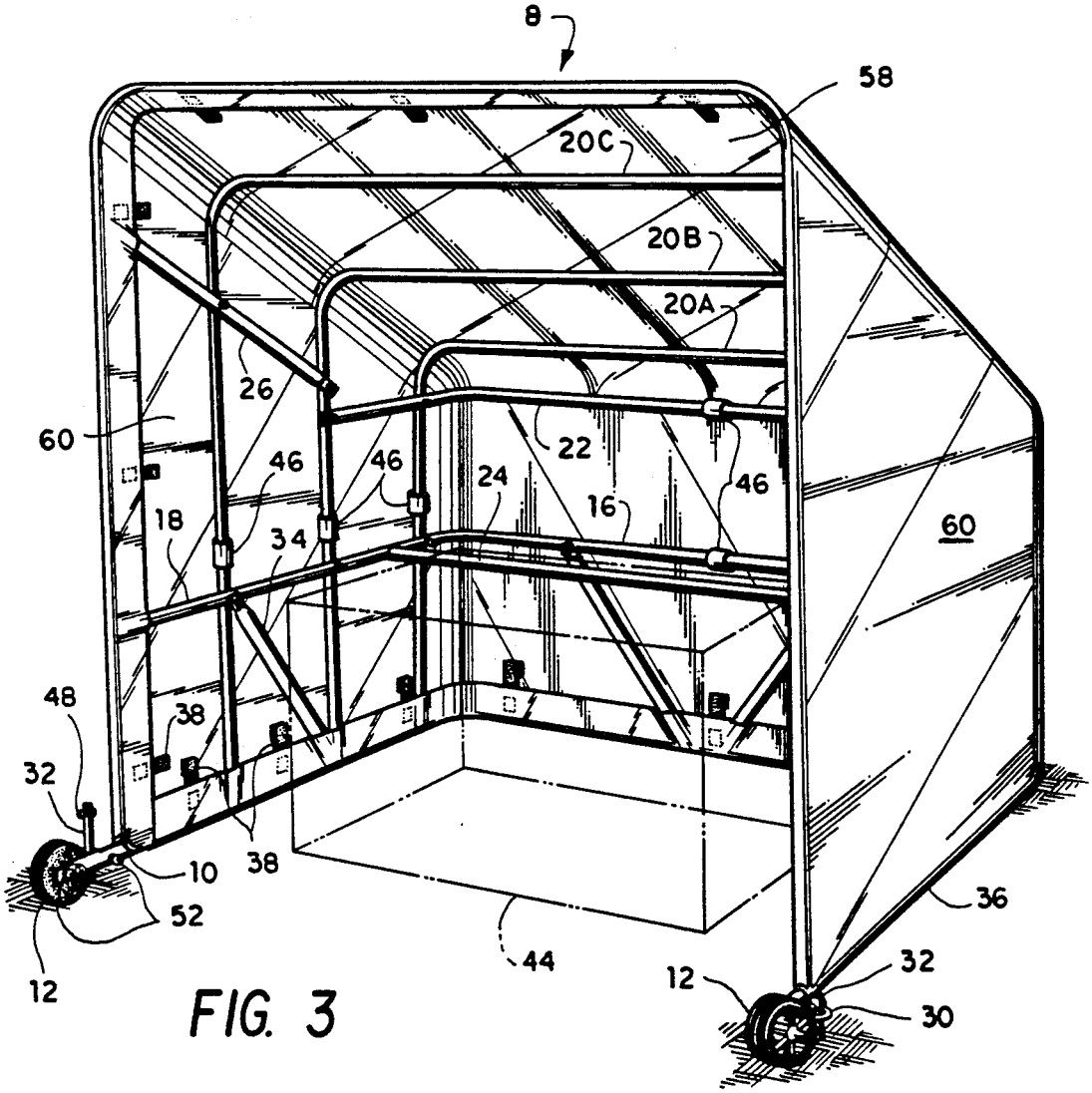
FIG. 3 is a perspective rear view showing the portable shelter covering an outdoor compressor viewed in phantom.

FIGS. 2 and 3 shows a thermo-reflective cover 36 which is form-fitted to the frame assembly 8 and secured by means of Velcro hook straps 38 and Velcro patches 40 which are attached to the underside of the cover 36. Once cover 36 is in place, the Velcro hook straps 38 and the Velcro patches 40 are pressed together to secure the thermal reflective cover 36 in place. The top piece 58 and side pieces 60 which combine to form the thermal reflective cover 36 are connected by means of a high strength reflective tape 42.

FIG. 3 shows the portable shelter in position covering a conventional air conditioner compressor unit 44 while leaving adequate room for air circulation. Bumper 24 engages unit 44 to limit positioning of the portable shelter. The shelter can have other shapes than that shown in the drawings, such as a dome or gable roof. The frame assembly materials can be tubular, square, angular or flat, can comprise different metals such as aluminum or steel, and can also be made of plastic materials or fiberglass. The thermal reflective cover 36 may comprise any durable material such as nylon, rayon, canvas, aluminum, fiberglass or plastic, and may be either opaque or translucent. The shelter may be sold in either kit form or preassembled ready for use.

While it will be apparent that the preferred embodiment of the invention herein disclosed is well calculated to fulfill the objects above stated, it will be appreciated that the invention is susceptible to modification, variation and change without departing from the proper scope or fair meaning of the subjoined claims.

I claim:

1. A portable shelter for an air conditioner unit comprising:

a separate assembly means forming a roof, sides and a front, said assembly means being open at the rear thereof and of sufficient size to allow adequate air circulation around a covered air conditioner unit, said roof, sides and front being joined together by conventional fasteners including swaged connectors, whereby said portable shelter is used year round to provide shelter for the air conditioner unit; and a thermal reflective cover means mounted on the assembly means; whereby in use the air conditioner unit is protected year round from the elements such as falling rain and wind-blown debris, and the sun's rays are reflected, thereby allowing the air conditioner unit when operated to function more efficiently at a cooler temperature.

2. A portable shelter as in claim 1 wherein:

the assembly means and cover means are provided in modular form.

3. A portable shelter as in claim 2, wherein:

the roof is sloping and the sides and front are vertical.

4. A portable shelter as in claim 1, wherein:

the roof is sloping and the sides and front are vertical.

5. A portable shelter as in claim 4, wherein: the assembly means comprises a frame formed of tubular metal members suitably joined together by said fasteners, wheel means are mounted on said frame for ease of portability, and anchoring means are provided for holding said portable shelter in position.

6. A portable shelter as in claim 5, wherein said tubular metal members include:

a lower support frame formed in two L-shaped parts joined by conventional tube connectors including said swaged connectors;

vertical roof support frames connected to said lower support frame and bearing conventional tube connectors including said swaged connectors at the upper ends thereof;

a lower U-shaped frame support connected to said vertical roof support frames by suitable connecting means included in said conventional fasteners, and to said lower support frame by means of front frame supports and anti-sway bars;

a plurality of roof support beams of varying heights to provide said sloping roof, said roof support beams being connected to said vertical roof support frames by said conventional tube connectors including said swaged connectors thereon;

an upper U-shaped frame support connected to two of said roof support beams by conventional bolt and nut means included in said conventional fasteners;

side frame supports connected to three of said roof support beams by means of conventional bolts and nuts included in said conventional fasteners;

a front stand or handle suitably mounted on said lower support frame; and an air conditioner bumper guard within said portable shelter for limiting the position of said portable shelter relative to an air conditioner unit therewithin.

7. A portable shelter as in claim 6, further comprising: eyebolt means mounted on said lower support frame and said front stand or handle;

said anchoring means comprising anchoring rods having depth-limiting means connected thereto;

said anchoring rods being driven into the ground through said eyebolt means to thereby hold said portable shelter in location to cover an air conditioner unit.

8. A portable shelter as in claim 7, said thermal reflective cover means comprising:

two suitably configured side pieces and at least one top piece;

said pieces being connected by high-strength reflective tape;

said thermal reflective cover means being mounted on said frame by Velcro connecting means.

9. A portable shelter as in claim 2, said thermal reflective cover means comprising:

two suitably configured side pieces and at least one top piece;

said pieces being connected by high-strength reflective tape;

said thermal reflective cover means being mounted on said assembly means by Velcro connecting means.

10. A portable shelter as in claim 2, said assembly means being formed of a suitable material selected from aluminum, steel, plastics and fiberglass.

11. A portable shelter as in claim 8, said frame being formed of a suitable material selected from aluminum, steel, plastics and fiberglass.

12. A portable shelter as in claim 2, said thermal reflective cover means comprising a durable covering material selected from nylon, rayon, canvas, aluminum, plastics and fiberglass.

13. A portable shelter as in claim 8, said thermal reflective cover means comprising a durable covering material selected from nylon, rayon, canvas, aluminum, plastics and fiberglass.

14. A portable shelter as in claim 8, wherein the assembly means and cover means are provided in modular form.

15. A portable shelter as in claim 11, wherein the assembly means and cover means are provided in modular form.

16. A portable shelter as in claim 13, wherein the assembly means and cover means are provided in modular form.

* * * * *